US010610716B2

(12) United States Patent
Beagen et al.

(10) Patent No.: US 10,610,716 B2
(45) Date of Patent: Apr. 7, 2020

(54) SPRINKLER DROP BRACKET FOR INTERSECTING DOWNLIGHT

(71) Applicant: Anvil International, LLC, Exeter, NH (US)

(72) Inventors: Joseph Beagen, Providence, RI (US); Odair Dafonseca, Pawtucket, RI (US)

(73) Assignee: Anvil International, LLC, Exeter, NH (US)

( * ) Notice: Subject to any disclaimer, the term of this patent is extended or adjusted under 35 U.S.C. 154(b) by 0 days.

(21) Appl. No.: 16/140,676

(22) Filed: Sep. 25, 2018

(65) Prior Publication Data

US 2019/0022443 A1 Jan. 24, 2019

Related U.S. Application Data

(63) Continuation-in-part of application No. 15/987,355, filed on May 23, 2018, now Pat. No. 10,426,985, (Continued)

(51) Int. Cl.
*A62C 35/68* (2006.01)
*B05B 15/62* (2018.01)
(Continued)

(52) U.S. Cl.
CPC ..... *A62C 35/68* (2013.01); *B05B 15/62* (2018.02); *E04B 9/006* (2013.01); *E04B 9/067* (2013.01);
(Continued)

(58) Field of Classification Search
CPC .... F16L 3/24; F16B 2/10; A62C 35/68; E04B 9/006; E04B 9/14; E04B 9/067; E04B 9/183; E04B 9/241; B05B 15/62
USPC ... 248/49, 65, 72, 73, 74.1, 121, 200, 218.4, 248/219.2, 219.4, 220.21, 220.31, 221.11, 248/224.7, 229.1, 227.4, 313, 316.1, 248/316.5, 346.01, 75, 342, 343
See application file for complete search history.

(56) References Cited

U.S. PATENT DOCUMENTS 796,178 A 8/1905 Beaton
833,613 A 10/1906 Maiser
(Continued)

FOREIGN PATENT DOCUMENTS

WO 2018226525 12/2018

OTHER PUBLICATIONS

Beagen, Joseph; Final Office Action for U.S. Appl. No. 15/987,355, filed May 23, 2018, dated Mar. 14, 2019, 14 pgs.
(Continued)

*Primary Examiner* — Brent W Herring
(74) *Attorney, Agent, or Firm* — Taylor English Duma LLP

(57) ABSTRACT

A bracket assembly includes a mounting bracket including a main body and at least one support arm, the at least one support arm extending outward from the main body, the main body defining a mounting pad; and a clamp attached to the mounting pad. A sprinkler support assembly includes a ceiling system including a suspension frame and a grid support, the grid support extending laterally outward from the suspension frame; and a bracket assembly including a main body and at least one support arm, the main body attached to the grid support, the at least one support arm extending outward from the main body.

14 Claims, 12 Drawing Sheets

Related U.S. Application Data which is a continuation of application No. 15/617,389, filed on Jun. 8, 2017, now Pat. No. 10,010,731.

(51) Int. Cl.

| | |
|---|---|
| ***E04B 9/06*** | (2006.01) |
| ***E04B 9/18*** | (2006.01) |
| ***E04B 9/00*** | (2006.01) |
| ***E04B 9/14*** | (2006.01) |
| *E04B 9/24* | (2006.01) |

(52) U.S. Cl.

CPC ..... *E04B 9/14* (2013.01); *E04B 9/183* (2013.01); *E04B 9/241* (2013.01)

(56) References Cited

U.S. PATENT DOCUMENTS

| | | | | |
|---|---|---|---|---|
| 949,576 | A | 2/1910 | Hunter | |
| 3,696,571 | A | 10/1972 | Schluter | |
| 3,703,307 | A | 11/1972 | Curtis et al. | |
| 3,785,110 | A | 1/1974 | Galloway et al. | |
| 4,041,657 | A | 8/1977 | Schuplin | |
| 4,570,391 | A | 2/1986 | Quante et al. | |
| 4,791,993 | A | 12/1988 | Curran | |
| 4,834,186 | A | 5/1989 | Ballard | |
| 5,331,785 | A | 7/1994 | Brak | |
| 5,354,952 | A | 10/1994 | Hickey | |
| 5,396,959 | A | 3/1995 | MacDonald | |
| D357,544 | S | 4/1995 | Spransy | |
| 5,542,713 | A | 8/1996 | Miyazaki et al. | |
| 5,698,820 | A | 12/1997 | Collard | |
| 5,699,641 | A | 12/1997 | Tinen et al. | |
| 5,711,551 | A | 1/1998 | Miyazaki et al. | |
| 5,883,332 | A | 3/1999 | Collard | |
| 6,119,784 | A | 9/2000 | MacDonald, III et al. | |
| 6,123,154 | A | 9/2000 | MacDonald, III et al. | |
| 6,158,519 | A | 12/2000 | Kretschmer | |
| 6,260,810 | B1 | 7/2001 | Choi | |
| 6,286,265 | B1 | 9/2001 | Rinderer | |
| 6,341,466 | B1 | 1/2002 | Kehoe et al. | |
| 6,488,097 | B1 | 12/2002 | MacDonald et al. | |
| 6,554,231 | B2 | 4/2003 | Choi | |
| 6,752,218 | B2 | 6/2004 | MacDonald et al. | |
| 7,090,174 | B2 * | 8/2006 | Korczak | F16B 21/075 248/58 |
| 7,255,315 | B2 | 8/2007 | Oh | |
| 7,427,051 | B2 | 9/2008 | Oh | |
| 7,506,845 | B2 | 3/2009 | Oh | |
| 7,510,159 | B2 | 3/2009 | Rippel | |
| 7,735,787 | B2 | 6/2010 | Kafenshtok et al. | |
| 7,735,794 | B1 | 6/2010 | Gretz | |
| 7,878,464 | B2 | 2/2011 | Oh | |
| 7,956,285 | B2 | 6/2011 | Tally et al. | |
| 8,272,615 | B2 | 9/2012 | Silcox et al. | |
| 8,474,199 | B2 | 7/2013 | Oh | |
| 8,500,079 | B2 * | 8/2013 | Oh | A62C 35/68 239/283 |
| 8,678,330 | B2 | 3/2014 | Silcox et al. | |
| 8,720,147 | B2 | 5/2014 | Roman | |
| 8,740,158 | B2 | 6/2014 | Silcox et al. | |
| 8,833,718 | B2 * | 9/2014 | Oh | A62C 35/68 239/283 |
| 8,955,273 | B1 * | 2/2015 | Lehane, Jr. | E04B 9/122 52/220.6 |
| 9,004,421 | B2 * | 4/2015 | Feenstra | A62C 35/68 248/200.1 |
| 9,004,422 | B2 | 4/2015 | Feenstra | |
| 9,109,724 | B2 | 8/2015 | Meissner et al. | |
| 9,174,077 | B2 | 11/2015 | Lim | |
| 9,278,238 | B2 * | 3/2016 | Thau, Jr. | F16B 2/10 |
| 9,889,327 | B2 | 2/2018 | Mitchell et al. | |
| 10,006,613 | B2 | 6/2018 | Oudina et al. | |
| 10,010,731 | B1 | 7/2018 | Beagen et al. | |
| 10,016,644 | B2 | 7/2018 | Seo et al. | |
| 10,082,279 | B2 | 9/2018 | Jones et al. | |
| 10,426,985 | B2 | 10/2019 | Beagen et al. | |
| 2002/0066834 | A1 | 6/2002 | Choi | |
| 2003/0089828 | A1 * | 5/2003 | Korczak | F16B 21/075 248/68.1 |
| 2006/0249633 | A1 * | 11/2006 | Korczak | F16B 21/075 248/62 |
| 2011/0154755 | A1 | 6/2011 | Oh | |
| 2011/0260012 | A1 * | 10/2011 | Oh | A62C 35/68 248/89 |
| 2011/0315409 | A1 | 12/2011 | Silcox et al. | |
| 2012/0167514 | A1 * | 7/2012 | Lehane, Jr. | E04B 9/0478 52/506.07 |
| 2012/0217354 | A1 * | 8/2012 | Walraven | F16L 3/1025 248/74.1 |
| 2013/0048822 | A1 * | 2/2013 | Liu | F16B 2/10 248/316.5 |
| 2013/0105640 | A1 * | 5/2013 | Feenstra | A62C 35/68 248/75 |
| 2013/0105641 | A1 | 5/2013 | Feenstra et al. | |
| 2013/0291461 | A1 * | 11/2013 | Oh | A62C 35/68 52/220.6 |
| 2015/0040495 | A1 * | 2/2015 | Lehane, Jr. | E04B 9/122 52/220.6 |
| 2015/0060613 | A1 | 3/2015 | Lim | |
| 2015/0377386 | A1 | 12/2015 | Mitchell et al. | |
| 2016/0010764 | A1 * | 1/2016 | Dworak, Jr. | F16L 3/1215 248/72 |
| 2016/0047496 | A1 * | 2/2016 | O'Connell | F16L 59/16 248/72 |
| 2016/0289964 | A1 | 10/2016 | Engberg | |
| 2016/0296778 | A1 | 10/2016 | Seo et al. | |
| 2017/0307188 | A1 | 10/2017 | Oudina et al. | |
| 2017/0336058 | A1 | 11/2017 | Jones et al. | |
| 2018/0100607 | A1 | 4/2018 | Dafonseca et al. | |
| 2018/0353787 | A1 | 12/2018 | Beagen et al. | |
| 2019/0366139 | A1 | 12/2019 | Beagen et al. | |
| 2019/0366140 | A1 | 12/2019 | Beagen et al. | |

OTHER PUBLICATIONS

Beagen, Joseph; Notice of Allowance for U.S. Appl. No. 15/987,355, filed May 23, 2018, dated May 17, 2019, 5 pgs.

Beagen, Joseph; Issue Notification for U.S. Appl. No. 15/617,389, filed Jun. 8, 2017, dated Jun. 13, 2018, 1 pg.

Beagen, Joseph; Non-Final Office Action for U.S. Appl. No. 15/617,389, filed Jun. 8, 2017, dated Dec. 28, 2017, 11 pgs.

Beagen, Joseph; Notice of Allowance for U.S. Appl. No. 15/617,389, filed Jun. 8, 2017, dated Feb. 23, 2018, 9 pgs.

Beagen, Joseph; Non-Final Office Action for U.S. Appl. No. 15/987,355, filed May 23, 2018, dated Nov. 9, 2018, 20 pgs.

Beagen, Joseph; International Search Report and Written Opinion for PCT Application No. PCT/US18/35579, filed Mar. 1, 2018, dated Aug. 29, 2018, 7 pgs.

Installation Instructions Document entitled 'USAI Connect Housing Installation Use With Armstrong 4" Intersection Downlighting Kit' (USAI, LLC) 2016, Entire document.

Beagen, Joseph; Corrected Notice of Allowance for U.S. Appl. No. 15/987,355, filed May 23, 2018, dated Mar. 23, 2019, 7 pgs.

Beagen, Joseph; Non-Final Office Action for U.S. Appl. No. 16/540,544, filed Aug. 17, 2019, dated Sep. 17, 2019, 13 pgs.

Beagen, Joseph; Non-final Office Action for U.S. Appl. No. 16/540,544, filed Aug. 14, 2019, dated Jan. 6, 2020, 14 pgs.

Beagen, Joseph; International Preliminary Report on Patentability for PCT Application No. PCT/US18/35579, filed Jun. 1, 2018, dated Dec. 19, 2019, 6 pgs.

* cited by examiner

SPRINKLER DROP BRACKET FOR INTERSECTING DOWNLIGHT

CROSS-REFERENCE TO RELATED APPLICATIONS

This application is a continuation-in-part of U.S. patent application Ser. No. 15/987,355, filed May 23, 2018, which is a continuation of U.S. patent application Ser. No. 15/617,389, filed Jun. 8, 2017, which issued into U.S. Pat. No. 10,010,731 on Jul. 3, 2018, each of which is hereby specifically incorporated by reference herein in its entirety.

BACKGROUND OF THE DISCLOSURE

Field of the Disclosure

The present disclosure relates to fire protection sprinkler drop support systems and, more particularly, to a sprinkler drop bracket for an intersecting downlight.

Discussion of Related Art

A typical automatic fire sprinkler system includes a network of pipes that carry a fire suppression fluid, e.g., water, to one or more rooms in a building. Conduit sections carry the fluid from the pipes to sprinkler heads strategically located in different rooms. The position and orientation of each sprinkler head is typically maintained in place by a support assembly. When the room reaches an elevated temperature due to a fire, the sprinkler head is activated, allowing a stream of fire suppression fluid to be directed over the intended area of coverage. The support assembly is used to hold the sprinkler securely in place during operation.

Some known sprinkler support assemblies are designed to be secured to a ceiling structure by fasteners. In grid-type ceiling systems, the sprinkler head typically extends through an opening in a central area of one or more ceiling tiles. This may be undesirable, however, in grid-type ceiling systems employing lighting fixtures (e.g., downlights) at an intersection of two or more ceiling tiles. One such prior art ceiling system is shown in FIG. 1. The ceiling system 10 includes a downlight suspension frame 12 connecting 4 (four) ceiling grid supports 14. The downlight suspension frame 12 and ceiling grid supports 14 are coupled to a yoke 18, which is suspended by a wire or cable 20. The yoke 18 may be secured atop two or more ceiling grid supports 14 by a set of brackets 24. A lighting fixture (not shown) may be disposed within a central area 30 of the downlight suspension frame 12 to illuminate an area below the ceiling system 10.

SUMMARY OF THE DISCLOSURE

In view of the foregoing, there is a need in the art for a bracket for coupling a fire sprinkler assembly to a downlight suspension frame of a ceiling grid system, wherein the bracket is easier to install and meets all fire safety industry requirements.

Disclosed is a bracket assembly comprising a mounting bracket comprising a main body and at least one support arm, the at least one support arm extending outward from the main body, the main body defining a mounting pad; and a clamp attached to the mounting pad.

Also disclosed is a sprinkler support assembly comprising a ceiling system comprising a suspension frame and a grid support, the grid support extending laterally outward from the suspension frame; and a bracket assembly comprising a main body and at least one support arm, the main body attached to the grid support, the at least one support arm extending outward from the main body.

Also disclosed is a method for assembling a sprinkler support assembly, the method comprising fitting a saddle of a mounting bracket over a grid support of a ceiling system; fastening an attachment leg of the mounting bracket to a suspension frame of the ceiling system with a fastener, the attachment leg disposed at a first bracket end of the mounting bracket, the saddle disposed at a second mounting bracket end of the mounting bracket opposite from the first bracket end, the grid support extending laterally outward from the suspension frame; and securing a sprinkler drop of a fire sprinkler assembly with a clamp, the clamp attached to the mounting bracket.

BRIEF DESCRIPTION OF THE DRAWINGS

The accompanying drawings illustrate exemplary approaches of the disclosure, including the practical application of the principles thereof, and in which.

Figure 1:
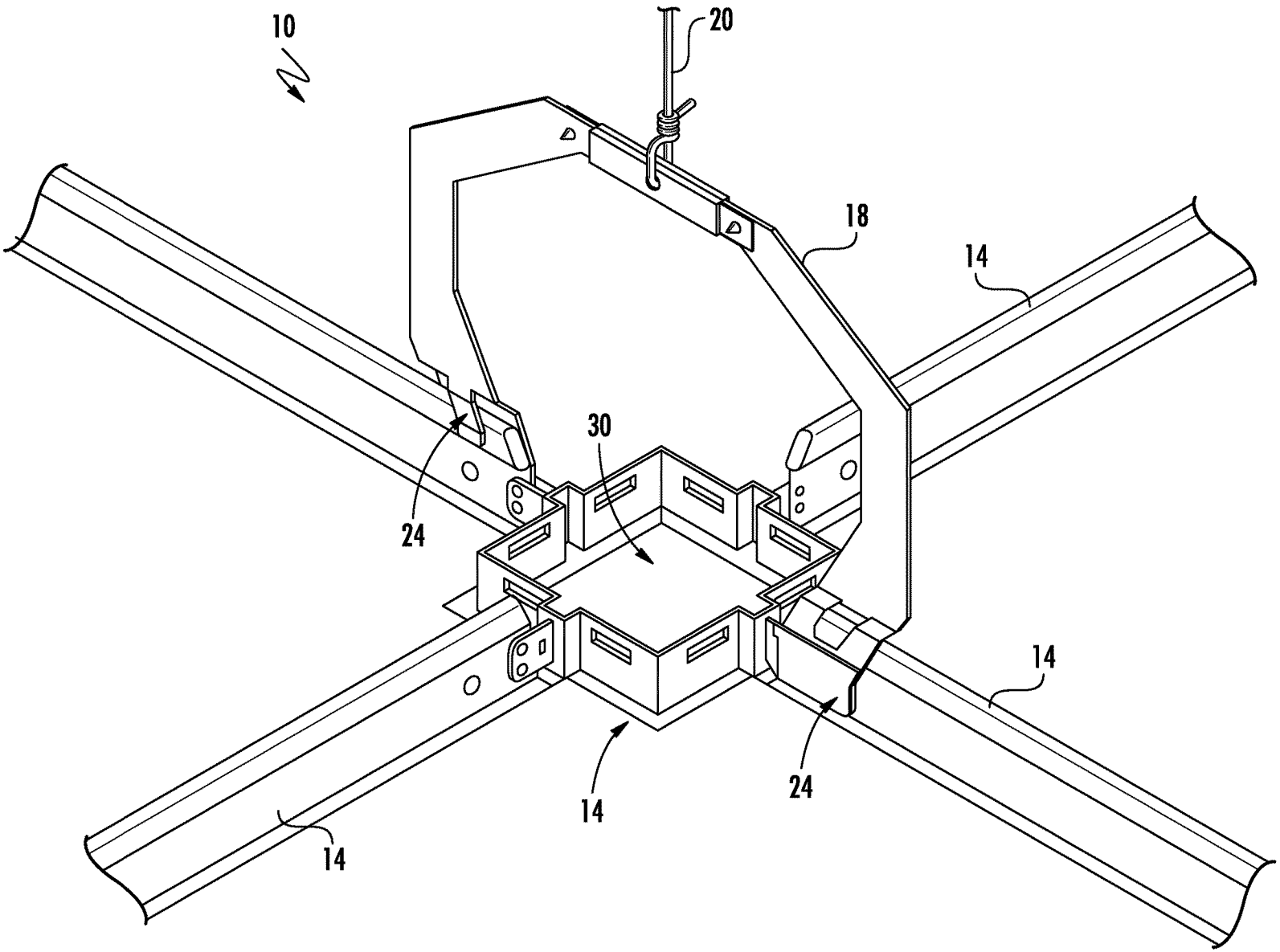
FIG. 1 PRIOR ART
FIG. 1 is a perspective view of a prior art ceiling system including a downlight suspension frame connecting a set of ceiling grid supports.

The drawings are not necessarily to scale. The drawings are merely representations, not intended to portray specific parameters of the disclosure. Furthermore, the drawings are intended to depict exemplary embodiments of the disclosure, and therefore is not considered as limiting in scope.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DESCRIPTION OF EMBODIMENTS

The present disclosure will now proceed with reference to the accompanying drawings, in which various approaches are shown. It will be appreciated, however, that the disclosed torch handle may be embodied in many different forms and should not be construed as limited to the approaches set forth herein. Rather, these approaches are provided so that this disclosure will be thorough and complete, and will fully convey the scope of the disclosure to those skilled in the art. In the drawings, like numbers refer to like elements throughout.

As used herein, an element or operation recited in the singular and proceeded with the word "a" or "an" should be understood as not excluding plural elements or operations, unless such exclusion is explicitly recited. Furthermore, references to "one approach" of the present disclosure are not intended to be interpreted as excluding the existence of additional approaches that also incorporate the recited features.

Furthermore, in the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As stated above, provided herein is a snap-to-grid bracket assembly for use with a fire suppression device. In one approach, a sprinkler support assembly includes a suspension frame coupled to a plurality of ceiling grid support elements, and a bracket assembly coupled to the suspension frame and to at least one of the plurality of ceiling grid support elements. The bracket assembly may include a main body extending partially into a central area of the suspension frame, the main body including a first set of seating members and a central opening. The bracket assembly may further include a support arm extending laterally from the main body, the support arm including a second set of seating members coupled to the at least one of the plurality of ceiling grid support elements. The sprinkler support assembly may be a retrofit solution that couples to an existing suspension frame of a downlight fixture.

Embodiments of the disclosure are compatible with a ceiling system including an overhead ceiling grid support system configured to be mounted in a suspended manner from an overhead building support structure via suitable hanger elements, such as for example, without limitation, fasteners, hangers, wires, cables, rods, struts, etc. The overhead ceiling grid support system includes a plurality of grid support members intersecting at a lighting fixture suspension frame. The ceiling grid support elements and/or the suspension frame may be hung by one or more hanger elements from the overhead building support structure and provide support for a portion of a fire suppression system, e.g., a sprinkler drop, a sprinkler heard, etc.

The ceiling grid support elements may be arranged to form an array of grid openings which receive and are essentially closed by ceiling tiles or panels when positioned within the grid openings. In some embodiments, ceiling grid support elements may be arranged in an orthogonal pattern and intersect at right angles (i.e. perpendicular) to form the grid openings which are rectilinear, such as squares or rectangles (in top plan view). The grid openings may be substantially coextensive with the length and width of the ceiling panels to be installed in the grid openings. The ceiling panels may be any type of ceiling panel, including without limitation, square edge panels, stepped tegular edge panels creating a reveal, or other. The ceiling panels may be constructed of any suitable material or combinations of different materials. Some non-limiting examples of ceiling panel materials that may be used include, without limitation, mineral fiber board, fiberglass, metals, polymers, wood, composites, combinations thereof, or other.

Exemplary embodiments of bracket assemblies for fire sprinkler support assemblies described herein may be designed for a T-bar suspended beam. When installing the bracket assembly onto the T-bar body and the suspension frame, an installer can "snap" the bracket assembly into place. In some embodiments, once the bracket assembly is positioned in place, the installer can further secure/anchor the bracket assembly to the T-bar beam using one or more fasteners. To un-anchor the bracket assembly from the T-bar beam, the installer may disengage/loosen/release the fastener to unlock the seating frame from the T-bar beam.

Figure 2:
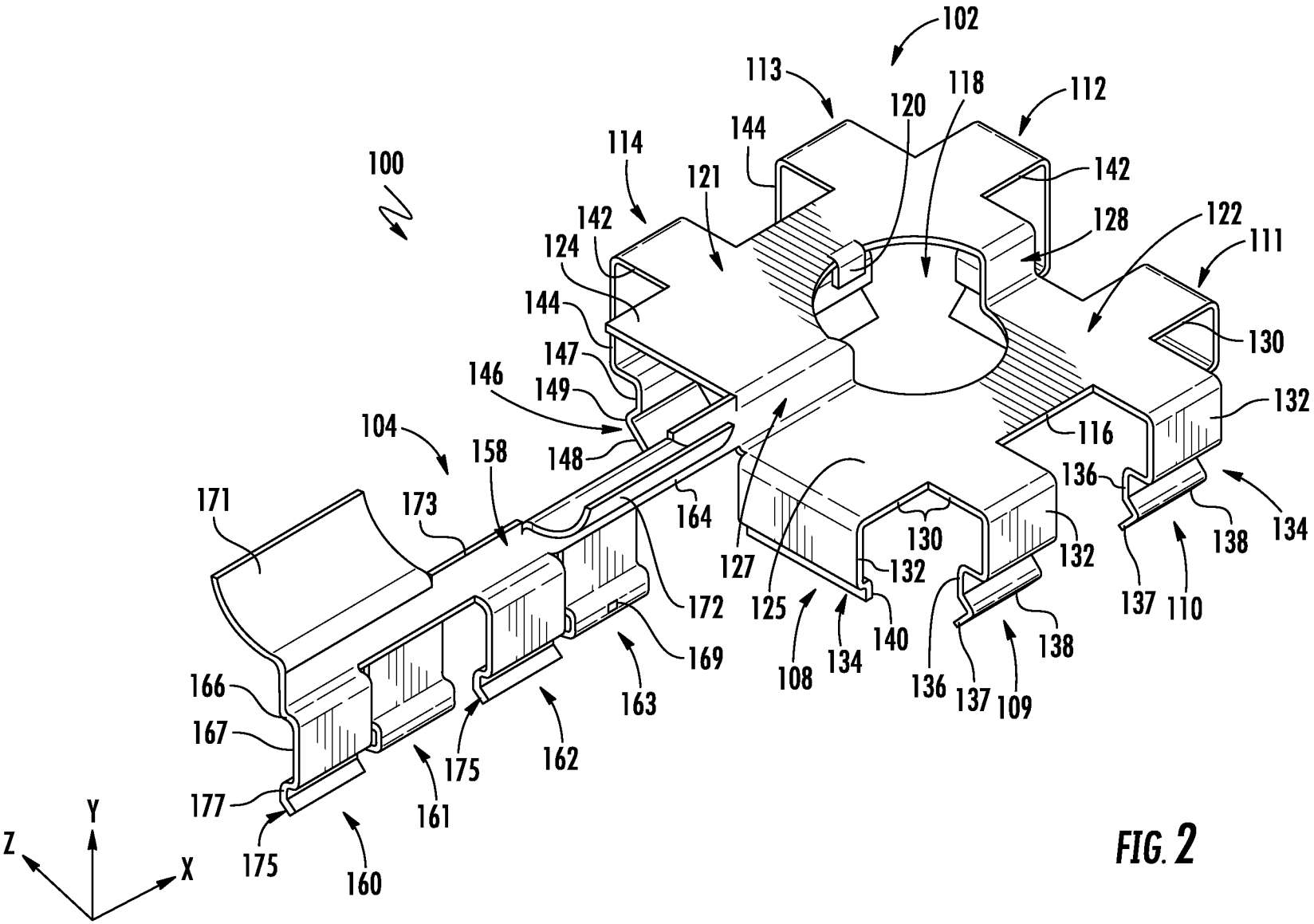
FIG. 2 is a perspective view of a bracket assembly according to approaches of the disclosure.
Figure 3:
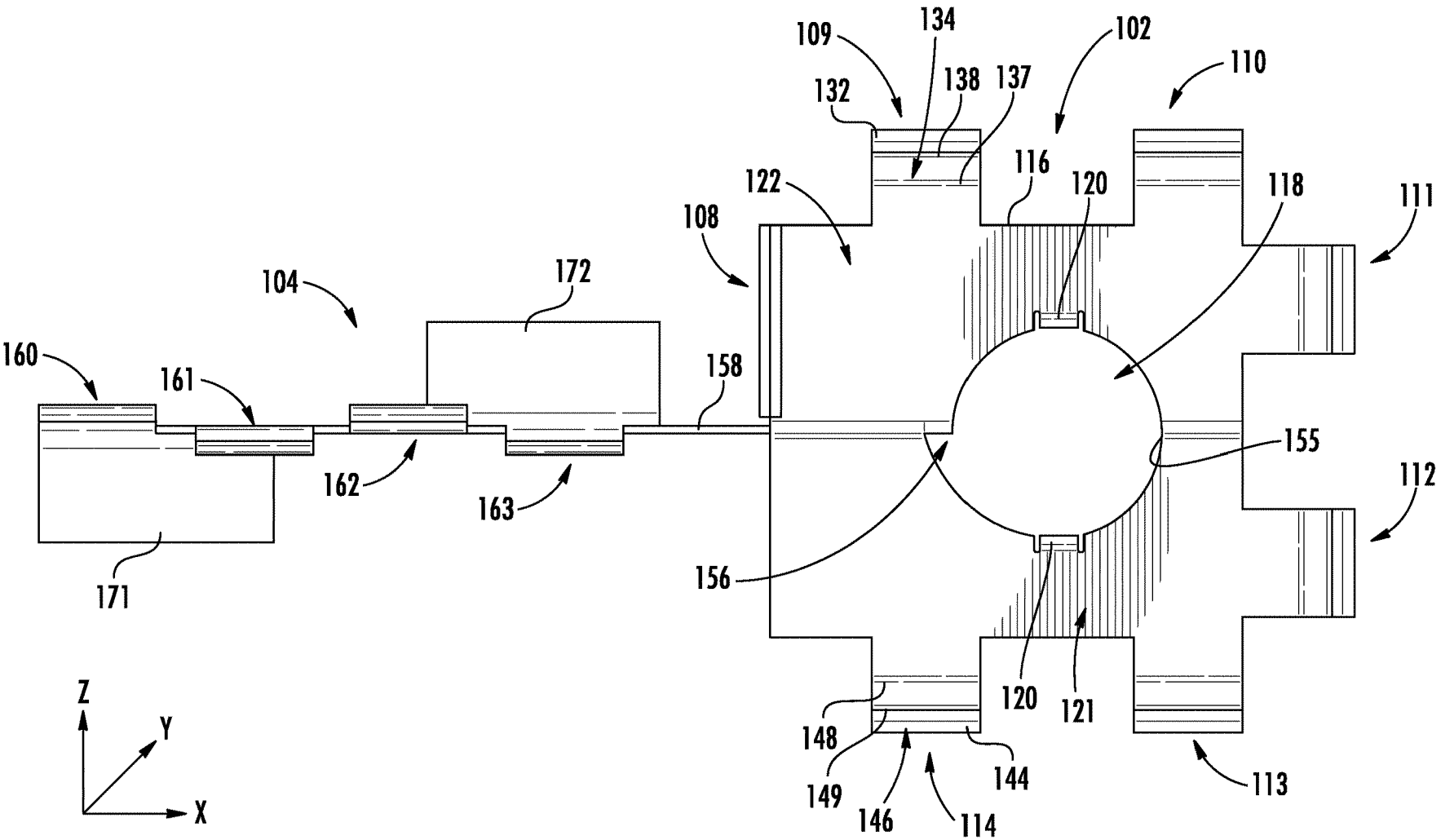
FIG. 3 is a bottom view of the bracket assembly of FIG. 2 according to approaches of the disclosure.
Figure 4:
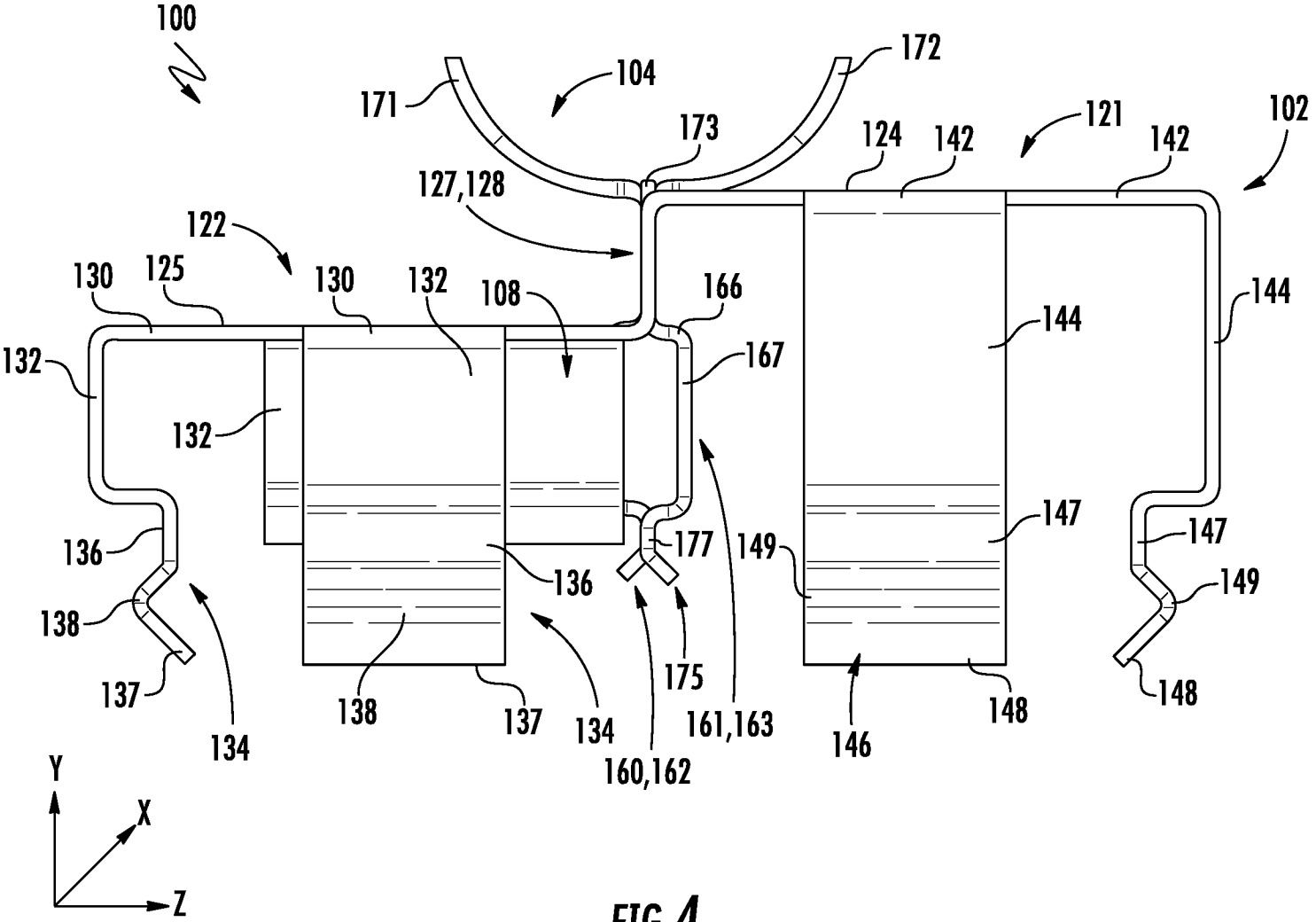
FIG. 4 is an end view of the bracket assembly of FIG. 2 according to approaches of the disclosure.

Turning now to FIGS. 2-4, a bracket assembly 100 of a fire sprinkler support assembly (hereinafter "support assembly") will be described in greater detail. As shown, the bracket assembly 100 may include a main body 102 coupleable with a suspension frame (e.g., a downlight suspension frame), and a support arm 104 extending laterally (e.g., along the x-axis) from the main body 102. As will be described in greater detail below, the support arm 104 and the main body 102 may support a sprinkler drop of a fire suppression system. The main body 102 may include a first set of seating members 108-114 (also referred to herein as "main body seating members") extending from an outer perimeter 116, and a central opening 118 including at least one fastener 120 (e.g., clip or clasp) for securing the sprinkler drop therein.

The main body 102 and the support arm 104 may be made of a suitable material including metal and non-metal. In one embodiment, the bracket assembly 100 is made of a flat metal plate or sheet of material formed to shape, such as without limitation aluminum, titanium, steel. In one implementation, the bracket assembly 100 is made of cold rolled steel which may be coated for corrosion resistance. The main body 102 and the support arm 104 may have the same or different thicknesses. Furthermore, the bracket assembly 100 may be formed and machined by any suitable metal fabrication method such as bending, stamping, rolling, forging, casting, cutting, milling, welding, soldering, or combinations thereof. A non-metal bracket assembly 100 may be formed by suitable methods, including without limitation, molding and others.

As shown, the main body 102 includes first and second sections 121, 122 on opposite sides of the central opening 118. A top surface 124 of the first section 121 defines a first plane (e.g., x-z plane), and a top surface 125 of the second section 122 defines a second plane (e.g., x-z plane), wherein the first plane and the second plane are parallel to one another. The first and second sections 121, 122 are connected by risers 127 and 128, which may be oriented perpendicular to the first and second planes. As shown, the top surface 124 of the first section 121 is vertically higher (e.g., along the y-axis) than the top surface 125 of the second section 122 so as to provide additional support for the sprinkler drop.

In some examples, each of the first set of seating members 108-114 extends laterally (e.g., along x-axis and z-axis) from the perimeter 116 of the main body 102. More specifically, each of seating members 108-111 of the second section 122 includes a first section 130 extending outwardly from the main body 102, for example, along the second plane defined by the top surface 125. A second section 132 extends perpendicularly, or substantially perpendicularly, from the first section 130, and a third section 134 extends from the second section 132. In some embodiments, the third section 134 of seating members 109-111 includes an upper section 136, a free end 137, and a protrusion 138 extending between the upper section 136 and the free end 137. As will be described in further detail below, the protrusion 138 extends outwardly away from the main body 102, and may be aligned with and engage an opening in a sidewall of the suspension frame. In some embodiments, the third section 134 of the seating member 108 includes only an extension member 140, which extends downward (e.g., along the y-axis), parallel to the second section 132. The extension member 140 is configured to engage an exterior surface of the suspension frame to provide further stability to the main body 102.

Similarly, each of seating members 112-114 of the first section 121 includes a first section 142 extending outwardly from the main body 102, for example, along the first plane defined by the top surface 124. A second section 144 extends perpendicularly, or substantially perpendicularly, from the first section 142, and a third section 146 extends from the second section 144. In some embodiments, the third section 146 of seating members 112-114 includes an upper section 147, a free end 148, and a protrusion 149 extending between the upper section 147 and the free end 148. As will be described in further detail below, the protrusion 149 may be aligned with and engage an opening in a sidewall of the suspension frame. As best shown in FIG. 4, in some embodiments, each of the seating members 109-114 extends vertically down to a same depth. Meanwhile, seating member 108 is generally shorter than seating members 109-114, and extends partially along an exterior of the suspension frame.

As more clearly shown in the bottom view of FIG. 3, the central opening 118 of the main body 102 may be snail-shaped. For example, a perimeter 155 defining central opening 118 includes a laterally extending irregularity or jut 156 provided to enable the main body 102 to be manufactured, for example, in the case the main body 102 is being made out of one piece of stamped steel and then folded. In the embodiment shown, the main body 102 includes a fasteners 120 disposed along the perimeter 155 on opposite sides of the central opening 118. The fasteners 120 engage/retain the sprinkler drop within the main body 102. In various embodiments, a variety of fasteners may be used to similarly hold the sprinkler drop in place.

Referring again to FIGS. 2-4, the support arm 104 will be described in greater detail. In some embodiments, the support arm 104 includes a shaft 158 and a second set of seating members 160-163 extending from the shaft 158. The shaft 158 is oriented perpendicular to the main body 102, and generally extends from the riser 127 between the first and second sections 121, 122 of the main body 102. The shaft 158 is aligned with the central opening 118 of the main body 102 to provide the sprinkler drop to the central opening 118 once assembled.

As shown, the seating members 160-163 extend downwardly from a bottom side 164 of the shaft 158 for engagement with a ceiling grid support element. Each of the seating members 160-163 includes a first section 166, which may be curved, extending outwardly (e.g., along the z-axis) from the shaft 158, and a second section 167 extending from the first section 166. The second section 167 is generally flat, and extends below the shaft 158. As shown, the second section 167 may be substantially parallel to the shaft 158. A third section 175 extends from the second section 167, and may be bent, angled, and/or include a protrusion 177 to engage the ceiling grid support element. As will be described in greater detail below, the seating members 160-163 are offset relative to one another so that the seating members 160-163 straddle the ceiling grid support element. In some embodiments, one or more of the seating members 160-163 may include an opening 169 to permit engagement with one or more fasteners used to secure the support arm 104 to the ceiling grid support element. Although four (4) seating members are shown, a greater or fewer number of seating members may be employed in alternative embodiments.

As further shown, the support arm 104 further includes a set of clamp members 171, 172 extending from an upper side 173 of the shaft 158. The clamp members 170, 171 may be curved and extend upwardly and outwardly from the support arm 104. The clamp members 171, 172 may extend outwardly in different directions (e.g., along the z-axis) relative to one another so that the clamp members 171, 172 support the sprinkler drop. Although two (2) clamp members are shown, a greater or fewer number clamp members may be employed in alternative embodiments.

Figure 5:
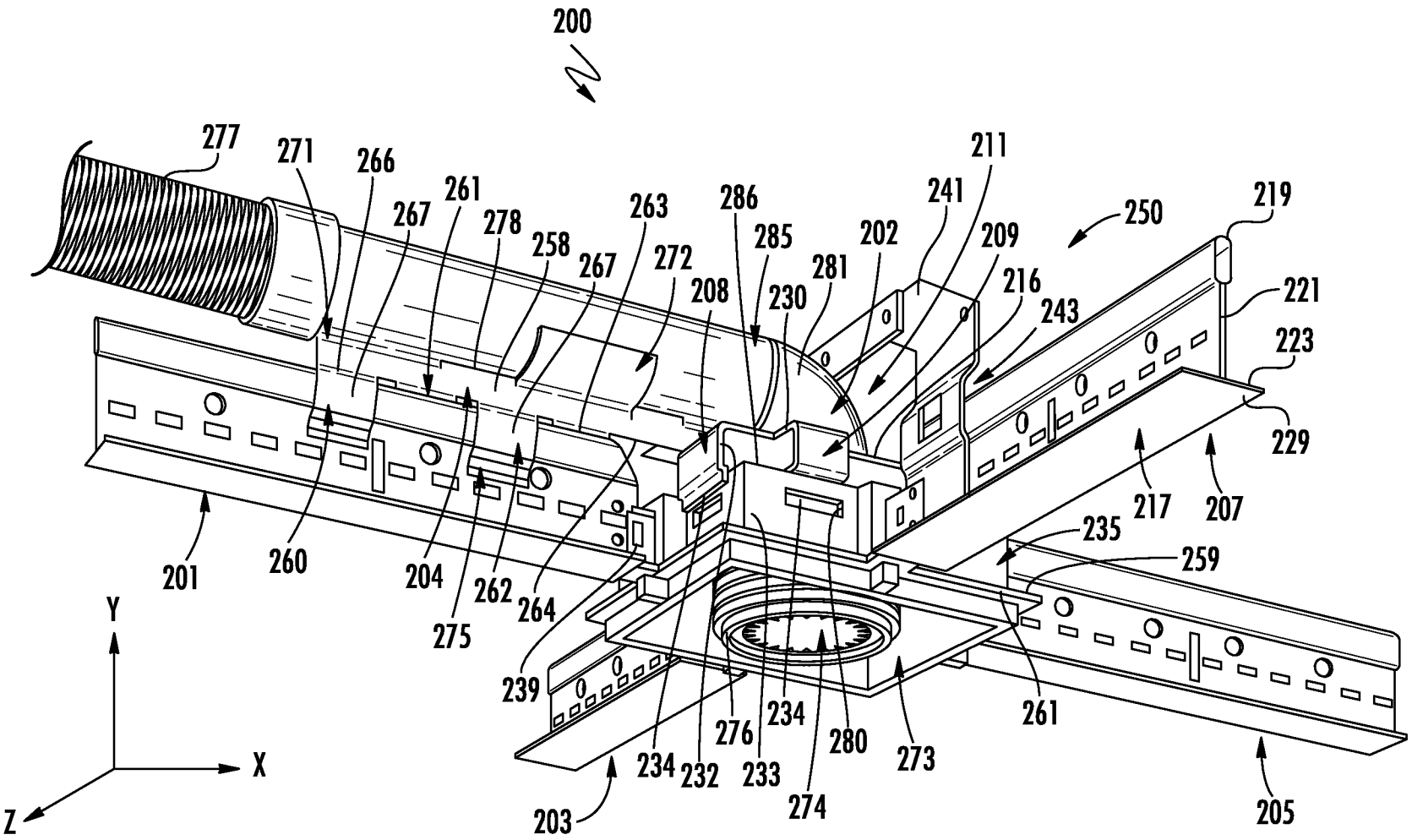
FIG. 5 is a perspective view of a fire sprinkler support assembly according to approaches of the disclosure.
Figure 6:
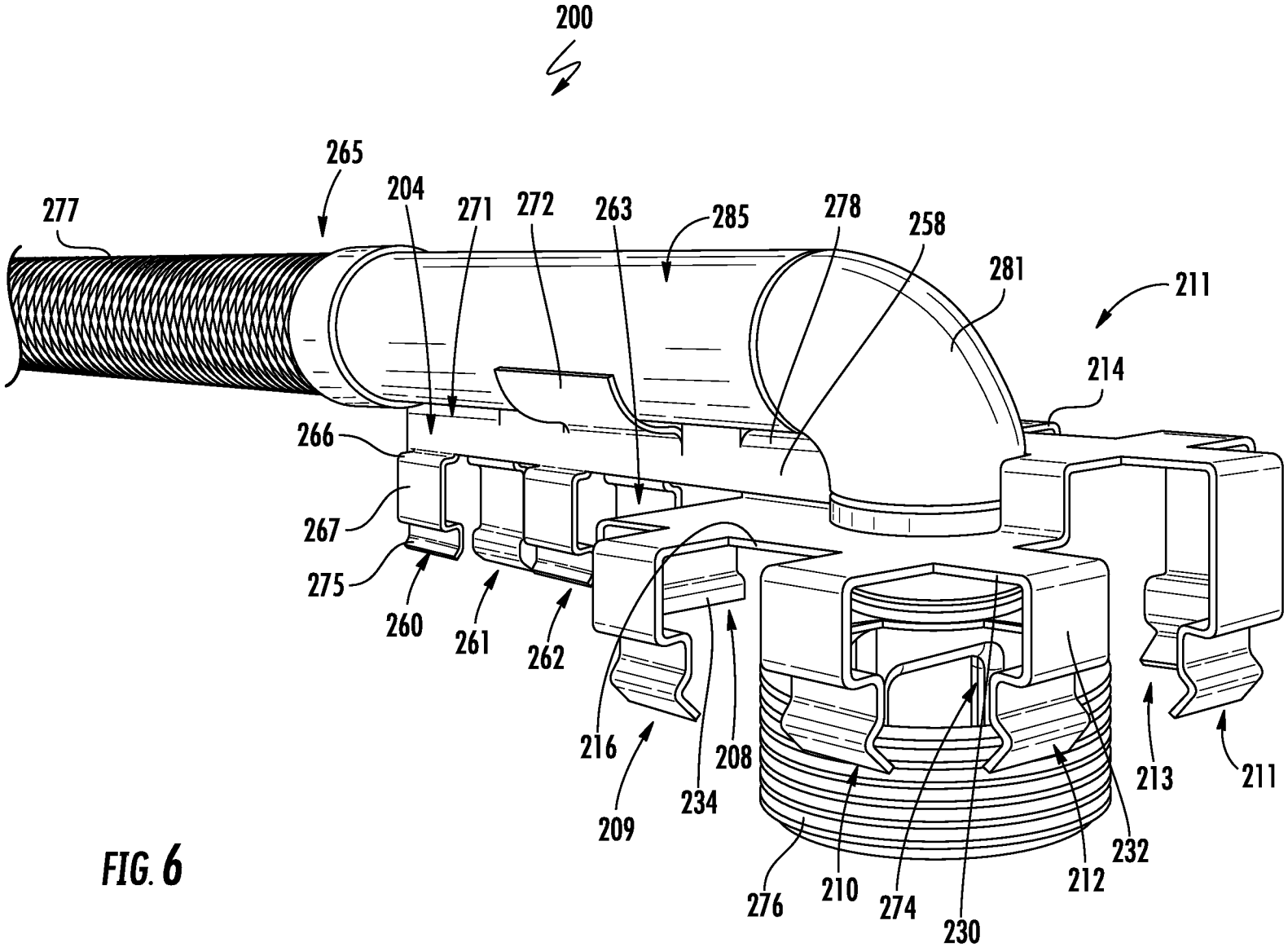
FIG. 6 is a perspective view of a bracket assembly according to approaches of the disclosure.

Turning now to FIGS. 5-6, a sprinkler support assembly (hereinafter "support assembly") 200 will be described in greater detail. FIG. 5 illustrates the entire support assembly 200, while FIG. 6 illustrates the support assembly 200 with certain components removed to better illustrate a fire sprinkler assembly 265 coupled to a bracket assembly 211. The bracket assembly 211, which may be the same or similar to the bracket assembly 100 of FIGS. 2-4, may be coupled to a suspension frame 235 and to a ceiling system 250 including one or more ceiling grid support elements 201, 203, 205, and 207. The ceiling grid support elements 201, 203, 205, and 207 may be arranged to form an array of grid openings which receive and are essentially closed by ceiling tiles or panels (not shown) when positioned within the grid openings.

Each of the ceiling grid support elements 201, 203, 205, and 207 may be t-shaped in a transverse cross-section and include a longitudinally-extending horizontal bottom flange 217, an enlarged stiffening channel 219 (also referred to as a bulb), and a vertical web 221 extending between the bottom flange 217 and the stiffening channel 219. In some embodiments, the stiffening channel 219 may be excluded. The bottom flange 217 has opposing portions which extend laterally outwards from the web 221 and terminate in opposed axially extending longitudinal edges. The web 221 may be centered between the longitudinal edges and vertically aligned beneath the stiffening channel 219. The bottom flange 217 also includes a top surface 223 and a bottom surface 229, wherein the top surface 223 provides a ledge for positioning and supporting a plurality of ceiling panels (not shown) thereupon.

In some embodiments, the ceiling system 250 may include a yoke 241 connected between two or more of ceiling grid support elements 201, 203, 205, and 207. For example, in the non-limiting embodiment shown, the yoke 241 may be secured to ceiling grid support elements 203 and 207 by one or more brackets 243, wherein the yoke 241 may be connected to a ceiling structure by a wire or cable (not shown). The brackets 243 may include a seating frame directly coupled to each ceiling grid support element 203 and 207, wherein the seating frame includes first and second seating members disposed on opposite sides of each ceiling grid support elements 203 and 207. In some embodiments, the first and second seating members straddle ceiling grid support elements 203 and 207. The seating frame of the brackets 243 provides stability to the support assembly yoke 241.

In some embodiments, the yoke 241 may be provided to support all components of the sprinkler support assembly 200. In other embodiments, some or all of the ceiling grid support elements 201, 203, 205, and 207 may also be suspended from an overlying building structure using, for example, flexible wire, and may be configured according to ASTM International standards. The standards may include, but are not limited to, those set forth in one or more of designations C635, C636 and E580, which are each incorporated herein by reference.

As shown, each of the ceiling grid support elements 201, 203, 205, and 207 are joined together by a suspension frame 235. The suspension frame 235 may be positioned centrally at an intersection of the ceiling grid support elements 201, 203, 205, and 207, wherein a set of connection clips 239 extend through a sidewall 233 of the suspension frame 235 to provide a code compliant connection therebetween. The suspension frame 235 further provides a central area/opening 273 for either a downlight or a sprinkler head 274. The suspension frame 235 may have a generally rectangular shape (top plan view) defined by the sidewall 233, and a cover (not shown) over the sprinkler head 274. The cover and the lower part of the suspension frame 235 may extend below a plurality of ceiling tiles (not shown) supported by an upper surface 259 of a ridge 261 extending around an outer surface of the sidewall 233. In the event of a fire, the cover is easily displaced. Although not limited to any particular type of light or lighting fixture, the suspension frame 235 may be suitable for use with an LED downlight.

However, according to embodiments of the present disclosure, the suspension frame 235 is used to support the fire sprinkler assembly 265 including supply pipes (not shown) and a sprinkler drop 285, which may be part of a fire suppression fluid delivery system. In some embodiments, the sprinkler drop 285 includes an elbow 281 coupled to the sprinkler head 274, which is surrounded by a baffle 276, and which is housed within the central area/opening 273 of the suspension frame 235. During operation, in the event of a fire, a thermally responsive device of the sprinkler head reacts to heat generated by the fire to allow fluid (e.g., water, nitrogen, and/or halogen) to flow through the sprinkler drop 285 and into the sprinkler head 274, where the fluid is dispersed outwardly to extinguish the fire.

In some embodiments, the sprinkler drop 285 is connected to a flexible conduit 277 including a flexible portion that comprises, for example, a corrugated tube, a hose, or a braided tube, which can be made from known materials including metal, rubber, etc. In one particular embodiment, the flexible conduit 277 is corrugated metal with a braided metal covering. The flexible conduit 277 may be flexible along its entire length, or may include one or more flexible portions adjacent more rigid portions. In one non-limiting embodiment, the flexible conduit may have a low elasticity so that when bent into a desired position, the flexible conduit it maintains its shape and does not return to its original position. In other embodiments, the conduit may be rigid or substantially rigid.

As further shown, the main body 202 of the bracket assembly 211 is coupled to the suspension frame 235, and the support arm 204 extends laterally (e.g., along the x-axis) from the main body 202 to support the sprinkler drop 285. The main body 202 includes a first set of seating members 208-214 extending laterally (e.g., along x-axis and z-axis) from the perimeter 216 of the main body 202. More specifically, each of seating members 208-214 includes a first section 230 extending outwardly from the main body 202, for example, along a plane defined by a top surface of the main body 202. A second section 232 extends perpendicularly, or substantially perpendicularly, from the first section 230, and a third section 234 extends from the second section 232. In some embodiments, the third section 234 includes a protrusion extending into an opening 280 in the sidewall 233 of the suspension frame 235 to align and secure the main body 202 to the suspension frame 235. The third section 234 of seating member 208 extends along the exterior surface of the sidewall 233 to provide further support for the main body 202. As further shown, one or more of the first set of seating members 208-214 engages a top surface 286 of the sidewall 233 of the suspension frame 235. In some embodiments, seating members 208-214 extend laterally beyond the sidewall 233 (e.g., in the x-z plane) to support the main body 202 and the sprinkler drop 285.

The support arm 204 includes a shaft 258 and a second set of seating members 260-263 extending from the shaft 258. The support arm 204 extends along a lengthwise axis (e.g., the x-axis) of the ceiling grid support element 201, wherein the lengthwise axis generally traverses along the vertical web 221 and/or the stiffening channel 219, between the flexible conduit 277 and the suspension frame 235. The shaft 258 is oriented perpendicular to the main body 202, and is aligned with the central opening of the main body 202 to guide the sprinkler drop 285 through the central opening during assembly. As shown, the seating members 260-263 generally extend downwardly from a bottom side 264 of the shaft 258 for engagement with ceiling grid support element 201. More specifically, a first section 266 and a second section 267 of each seating member 260-263 engages the stiffening channel 219, while a third section 275 engages the web 221 of ceiling grid support element 201. As arranged, the seating members 260-263 are offset relative to one another so that the seating members 260-263 are disposed on opposite sides of the ceiling grid support element 201.

The support arm 204 further includes the set of clamp members 271, 272 extending from the upper side 278 of the shaft 258. The clamp members 271, 272 may be curved and extend upwardly and outwardly from the shaft 258 to support the sprinkler drop 285. As shown, the clamp members 271, 272 may extend in opposite directions to cradle the sprinkler drop 285 therebetween.

In order to function effectively, the fire sprinkler assembly 265 must be held firmly in place during operation. Due to the significant back pressure of the fluid flowing therethrough, the sprinkler drop 285 may be subjected to significant side, rotational, and torsional forces, which are capable of changing the position of the fire sprinkler head extending from the sprinkler drop, thereby causing the fluid to be directed away from the intended target. It will be appreciated that the bracket assembly 211 is configured to resist movement of the sprinkler drop 285 by distributing the forces to the ceiling grid support elements 201, 203, 205, and 207 via the support arm 204 and the main body 202.

In some embodiments, each of the herein described bracket assemblies 100, 211 may include a barrier layer provided along one or more surfaces thereof. For example, a barrier layer including a set of plastic inserts may be formed along outer surfaces of the first and second sets of seating members. As shown, the plastic inserts may be open at a top thereof, and extend around the lower surfaces of the first and second sets of seating members. The inserts may increase durability and reduce friction between the first and second sets of seating member sand the beams of the ceiling system. Furthermore, in some embodiments, the plastic inserts may be useful for low-voltage suspended ceiling power distribution systems in which screws on the ceiling grids should not be used.

It will be appreciated that embodiments of the disclosure provide at least the following advantages. Firstly, the configuration of the seating elements of the main body and the support arm allows the bracket assembly to "snap" to the ceiling grid support element and to the suspension frame, thus allowing the fire sprinkler assembly to be installed faster, and potentially by hand, thus reducing tooling such as cordless drills and drivers. Secondly, the bracket assembly may be retrofit to existing downlight lighting suspension frames, thus providing symmetrical placement of sprinkler heads relative to lighting fixtures in grid-type ceiling systems employing lighting fixtures (e.g., downlights) at an intersection of two or more ceiling tiles.

Figure 7:
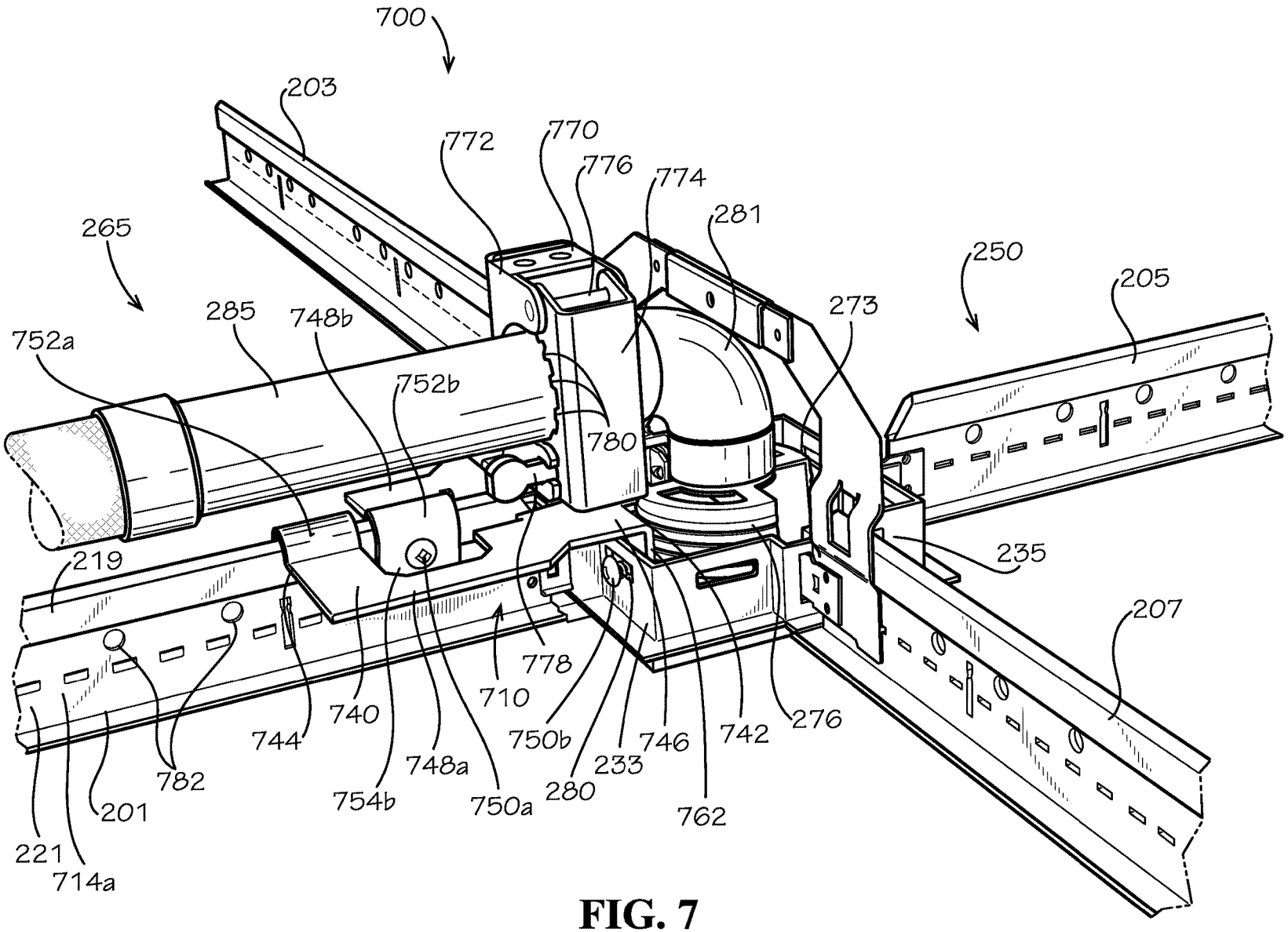
FIG. 7 is a perspective front view of another aspect of a sprinkler support assembly comprising the ceiling system of FIG. 5, the fire sprinkler assembly of FIG. 6, and another aspect of a bracket assembly in accordance with another aspect of the present disclosure.

FIG. 7 is a perspective front view of another aspect of a sprinkler support assembly 700 comprising the ceiling system 250 of FIG. 5, the fire sprinkler assembly 265 of FIG. 6, and another aspect of a bracket assembly 710 in accordance with another aspect of the present disclosure. The bracket assembly 710 can comprise a mounting bracket 740 and a clamp 770, which can be attached to the mounting bracket 740. The mounting bracket 740 can define a first mount end 742 and a second mount end 744 disposed opposite from the first mount end 742. The mounting bracket 740 can comprise a main body 746 and a pair of support arms 748*a,b*. The main body 746 can be positioned at the first mount end 742. The pair of support arms 748*a,b* can extend outwards and away from the main body 746. A first support arm 748*a* of the pair of support arms 748*a,b* can define the second mount end 744.

In the present aspect, each of support arms 748*a,b* can extend outward from the main body 746 along the grid support 201, and each of the support arms 748*a,b* can be laterally offset from the grid support 201 such that each of the support arms 748*a,b* can extend along opposite sides of the grid support 201 of the grid supports 201,203,205,207 of the ceiling system 250. The first support arm 748*a* can be laterally offset towards the grid support 207, and the first support arm 748*a* can extend along a first side 714*a* of the grid support 201. A second support arm 748*b* of the pair of support arms 748*a,b* can be laterally offset towards the grid support 203, and the second support arm 748*b* can extend along a second side 714*b* (shown in FIG. 8) of the grid support 201.

The mounting bracket 740 of the bracket assembly 710 can further comprise a pair of saddles 752*a,b*. A first saddle 752*a* of the pair of saddles 752*a,b* can be attached to the first support arm 748*a*, opposite from the main body 746. A second saddle 752*b* of the pair of saddles 752*a,b* can be attached to the second support arm 748*b*, opposite form the main body 746. In the present aspect, the second saddle 752*b* can be positioned between the first saddle 752*a* and the main body 746. In the present aspect, each of the saddles 752*a,b* can be integrally formed with the respective support arm 748*a,b*; however, in other aspects, the saddles 752*a,b* can be attached to the support arms 748*a,b* through a different method, such as fastening, welding, adhering, a snap-together fit, or any other suitable method.

The saddles 752*a,b* can each fit over the stiffening channel 219 of grid support 201. The saddles 752*a,b* can be shaped to conform to a profile of the stiffening channel 219. In some aspects, the saddles 752*a,b* can snap over the stiffening channel 219 to attach the mounting bracket 740 to the respective grid support 201. Each of the saddles 752*a,b* can respectively define a seating member 754*a,b* (seating member 754*a* shown in FIG. 8) which can engage the opposite sides 714*a,b* (second side 714*b* shown in FIG. 8) to laterally secure the mounting bracket 740 to the grid support 201. For example, the first saddle 752*a* can be attached to the first support arm 748*a* along the first side 714*a* of the grid support 201, and the seating member 754*a* can engage the second side 714*b* of the grid support 201. The second saddle 752*b* can be attached to the second support arm 748*b* along the second side 714*b* of the grid support, and the seating member 754*b* can engage the first side 714*a* of the grid support 201. The seating members 754*a,b* can extend below the stiffening channel 219 to engage the web 221 of the grid support 201 as well.

In the present aspect, saddle 752*b* can be secured to the grid support 201 with a fastener 750*a*. The fastener 750*a* can extend through the seating member 754*b* of the saddle 752*a* and through the stiffening channel 219 (fastener 750*a* shown extending through the stiffening channel 219 of the grid support 201 in FIG. 8) to secure the support arm 748*a* to the grid support 201. The web 221 of the grid support 201 can define a plurality of openings 782, and in other aspects, the fastener 750*a* can extend through the grid support 201 via a one of the openings 782. In other aspects, the saddle 752*a* can be secured to the grid support 201 with a fastener.

The main body 746 can be attached to the suspension frame 235. In the present aspect, an attachment leg 762 of the main body 746 can extend into the central area/opening 273; however, in other aspects, the main body 746 may not extend into the central area/opening 273. The attachment leg 762 can be attached to a one of the sidewalls 233 of the suspension frame 235 with another fastener 750*b*, which can extend through the sidewall 233 via the opening 280. In the present aspect, the grid support 201 and the attachment leg 762 can be attached to the same sidewall 233 of the suspension frame 235. In other aspects, the attachment leg 762 can attach to a different sidewall 233 than the grid support 201, to which the saddles 752*a,b* are attached.

The clamp 770 can be attached to the main body 746 of the mounting bracket 740 at the first mount end 742. The clamp 770 can engage the sprinkler drop 285 of the fire sprinkler assembly 265 to secure the fire sprinkler assembly 265 to the mounting bracket 740. The clamp 770 and the mounting bracket 740 can secure the elbow 281 in position over the baffle 276 within the central area/opening 273. The elbow 281 can be connected in fluid communication to the sprinkler head 274 (shown in FIG. 5) disposed within the baffle 276.

The clamp 770 can comprise a first clamp bracket 772 and a second clamp bracket 774. The first clamp bracket 772 can be hingedly connected to the second clamp bracket 774 by a hinge pin 776. The second clamp bracket 774 can be secured in a closed position, as shown, by a clasp 778. In the closed position, the clamp 770 can securely engage the sprinkler drop 285 to prevent relative movement between the clamp 770 and the sprinkler drop 285. The second clamp bracket 774 can define a plurality of teeth 780 which can engage the sprinkler drop 285 in the closed position to increase gripping strength of the clamp 770 on the sprinkler drop 285.

Figure 8:
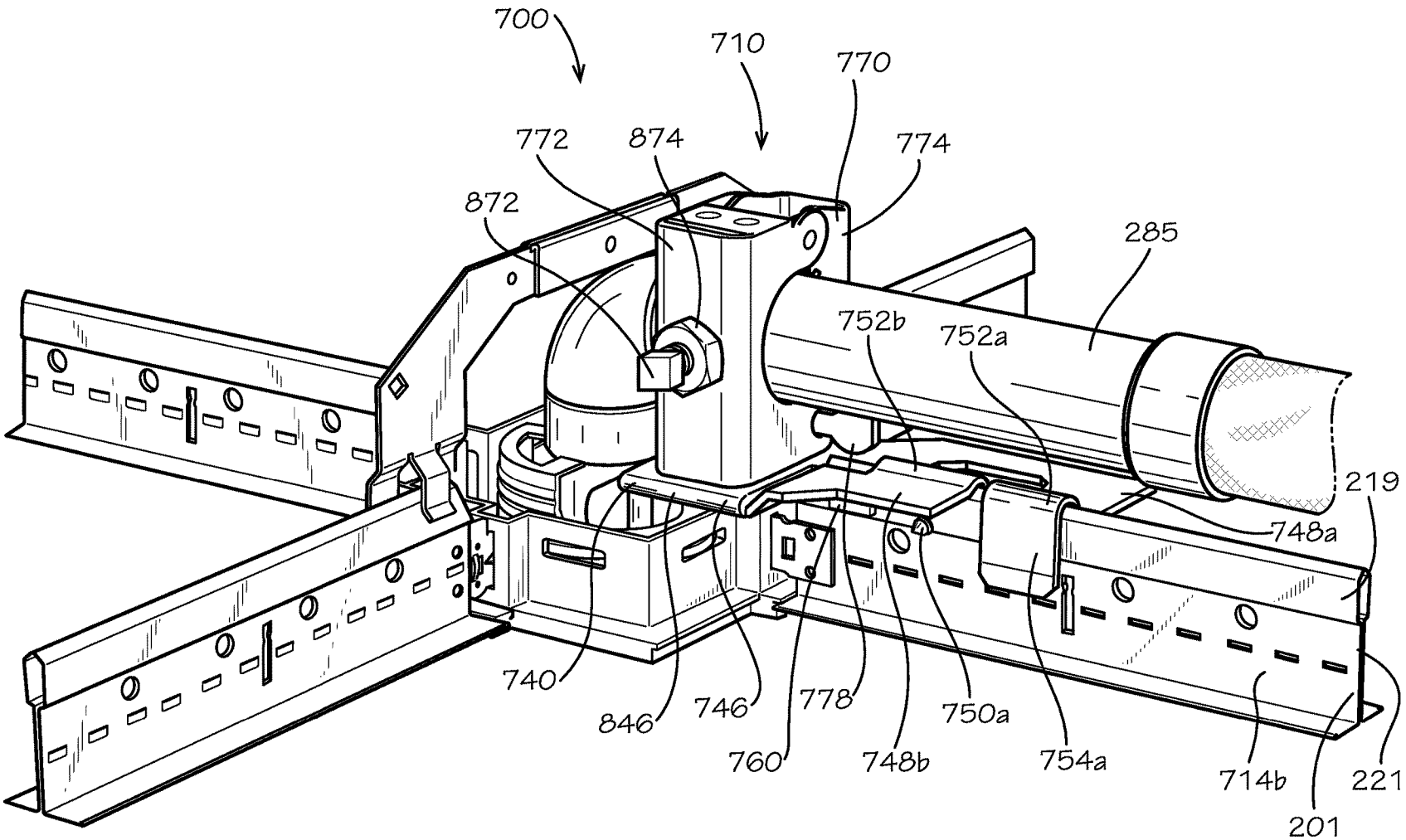
FIG. 8 is a perspective rear view the sprinkler support assembly of FIG. 7.

FIG. 8 is a perspective rear view the sprinkler support assembly 700 of FIG. 7. As shown, the seating member 754*a* of the saddle 752*a* can extend along the second side 714*b* of the grid support 201, and the seating member 754*a* can engage the web 221. In the present aspect, the seating member 754*a* may not be configured to receive a fastener; however, in other aspects, the seating member 754*a* can be attached to the grid support 201 by a fastener, similar to fastener 750*a*. The second support arm 748*b* can also define an alignment leg 760 which can extend substantially vertically downward.

With the mounting bracket 740 installed on the grid support 201, the stiffening channel 219 can be positioned between the supports arms 748*a,b*. The stiffening channel 219 can extend between the alignment leg 760, the seating member 754*a* of the saddle 752*a*, and the seating member 754*b* (shown in FIG. 7) of the saddle 752*b* in a mounting channel 1202 (shown in FIG. 12) defined by the mounting bracket 740. In particular, the seating member 754*b* can be positioned on the first side 714*a* (shown in FIG. 7) of the grid support 201, and the seating member 754*a* and the alignment leg 760 can be positioned on the second side 714*b* of the grid support 201 with the seating member 754*b* positioned between the seating member 754*a* and the alignment leg 760 along the length of the grid support 201. Each of the saddles 752*a,b* can extend up and over the stiffening channel 219 from the first side 714*a* to the second side 714*b*, and the saddles 752*a,b* can closely fit the contour of the stiffening channel 219.

The main body 746 of the mounting bracket 740 can define a mounting pad 846, and the clamp 770 can be attached to the mounting pad 846 to assemble the bracket assembly 710. The first clamp bracket 772 can comprise an adjustment screw 872. The adjustment screw 872 can be screwed into the first clamp bracket 772 to contact the sprinkler drop 285. Screwing the adjustment screw 872 further into the first clamp bracket 772 can press the sprinkler drop 285 into the plurality of teeth 780 (shown in FIG. 7) of the second clamp bracket 774 when the clamp 770 is secured in the closed position by the clasp 778.

The first clamp bracket 772 can further comprise a nut 874 which can threadedly engage the adjustment screw 872. In the present aspect, the first clamp bracket 772 can define a threaded hole (not shown) that the adjustment screw 872 can threadedly engage, and the nut 874 can be a jam nut that can be tightened against the first clamp bracket 772 to secure an adjusted position of the adjustment screw 872. In other aspects, the first clamp bracket 772 may not define a threaded hole, and the nut 874 can be welded, attached, or otherwise secured to the first clamp bracket 772 to provide a threaded hole to engage the adjustment screw 872.

Figure 9:
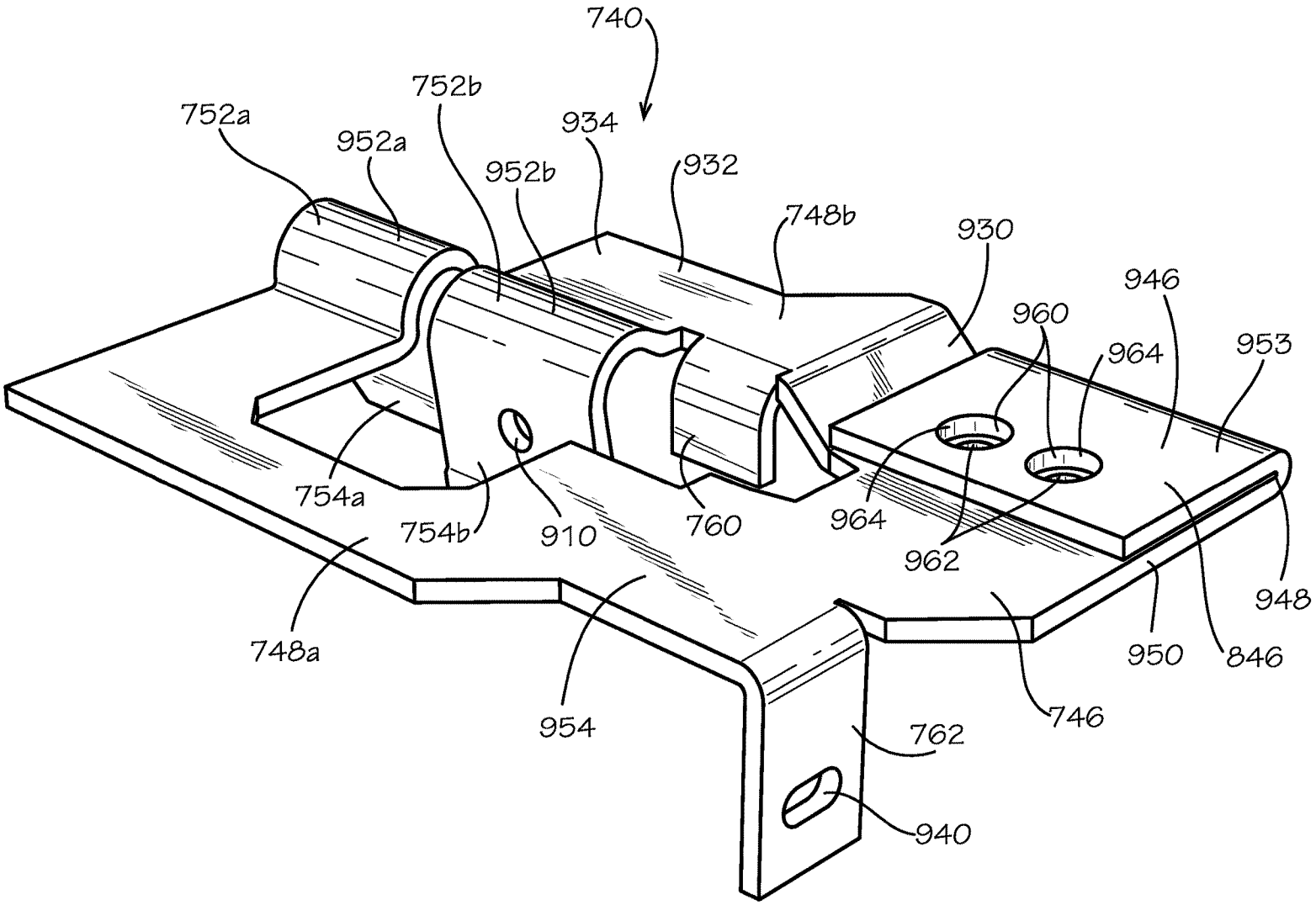
FIG. 9 is a perspective top view of a mounting bracket of the bracket assembly of FIG. 7.

FIG. 9 is a perspective top view of the mounting bracket 740 of FIG. 7. In the present aspect, the mounting bracket 740 can comprise a sheet or plate of material that has been bent to form the mounting bracket 740. For example and without limitation, the mounting bracket 740 can comprise a metal plate, such as aluminum, steel, iron, or any other suitable material, or a sheet of metal, polymer, composite, or any other suitable material, for example and without limitation. In other aspects, the mounting bracket 740 can be formed by another process such as additive manufacturing, including 3D-printing, machining, casting, forging, molding, or any other suitable process.

In the present aspect, the mounting pad 846 can be defined by a portion of the main body 746 in which the material has been folded to provide a thickened, two-layer area. The mounting pad 846 can be formed by folding a mounting tab 946 approximately 180-degrees about a fold line 948 relative to a base layer 950 of the mounting bracket 740. The resulting mounting pad 846 can provide increased rigidity for mounting the clamp 770 (shown in FIG. 7) to the mounting bracket 740. The mounting tab 946 can define a mounting surface 953 which can be positioned above and substantially parallel to a top base layer surface 954 defined by the base layer 950.

The mounting tab 946 can define a pair of top holes 960 that can align with a pair of bottom holes 962 defined by the base layer 950. The respective aligned top holes 960 and bottom holes 962 can together define a pair of mounting holes 964. In the present aspect, the top holes 960 can be larger in diameter than the bottom holes 962, and the mounting holes 964 can be countersunk holes. In other aspects, the holes 960,962 can be equal in diameter.

In the present aspect, the bottom holes 962 can be internally threaded, and the bottom holes 962 can be configured to receive threaded fasteners, such as bolts or screws, to attach the clamp 770 to the mounting bracket 740. In other aspects, the bottom holes 962 may not be internally threaded. In such aspects, the clamp 770 can be attached to the mounting bracket 740 with unthreaded fasteners, such as rivets for example and without limitation, or by using pairs of threaded fasteners, such as nuts and bolts for example and without limitation. In other aspects, the clamp 770 can be attached to the mounting bracket 740 through another method, such as welding, adhering, brazing, or any other suitable method without limitation.

The base layer 950 can be substantially planar. The base layer 950 can define a portion of the main body 746 and the first support arm 748*a*. An inclined portion 930 of the second support arm 748*b* can slope upwards from the base layer 950 to an elevated portion 932 of the second support arm 748*b*. The inclined portion 930 can be oblique relative to each of the base layer 950 and the elevated portion 932. The elevated portion 932 can define a top support arm surface 934 which can be positioned above and substantially parallel to the top base layer surface 954 and the mounting surface 953. The alignment leg 760 can extend substantially downward from the elevated portion 932 of the second support arm 748*b*. The attachment leg 762 can extend substantially vertically downward from the base layer 950, and the attachment leg 762 can define an attachment slot 940. The attachment slot 940 can be configured to receive the fastener 750*b* (shown in FIG. 7).

The first saddle 752*a* can define an arched portion 952*a* extending upwards from the first support arm 748*a*, and the seating member 754*a* can extend downwards from the arched portion 952*a*, below the first support arm 748*a*. The second saddle 752*b* can define an arched portion 952*b* extending upwards from the elevated portion 932 of the second support arm 748*b*, and the seating member 754*b* can extend downwards from the arched portion 952*b*, below the elevated portion 932. In the present aspect, the seating member 754*b* can extend downwards below the base layer 950. As shown, the seating member 754*b* can define a fastener hole 910 configured to receive the fastener 750*a* (shown in FIG. 7).

Figure 10:
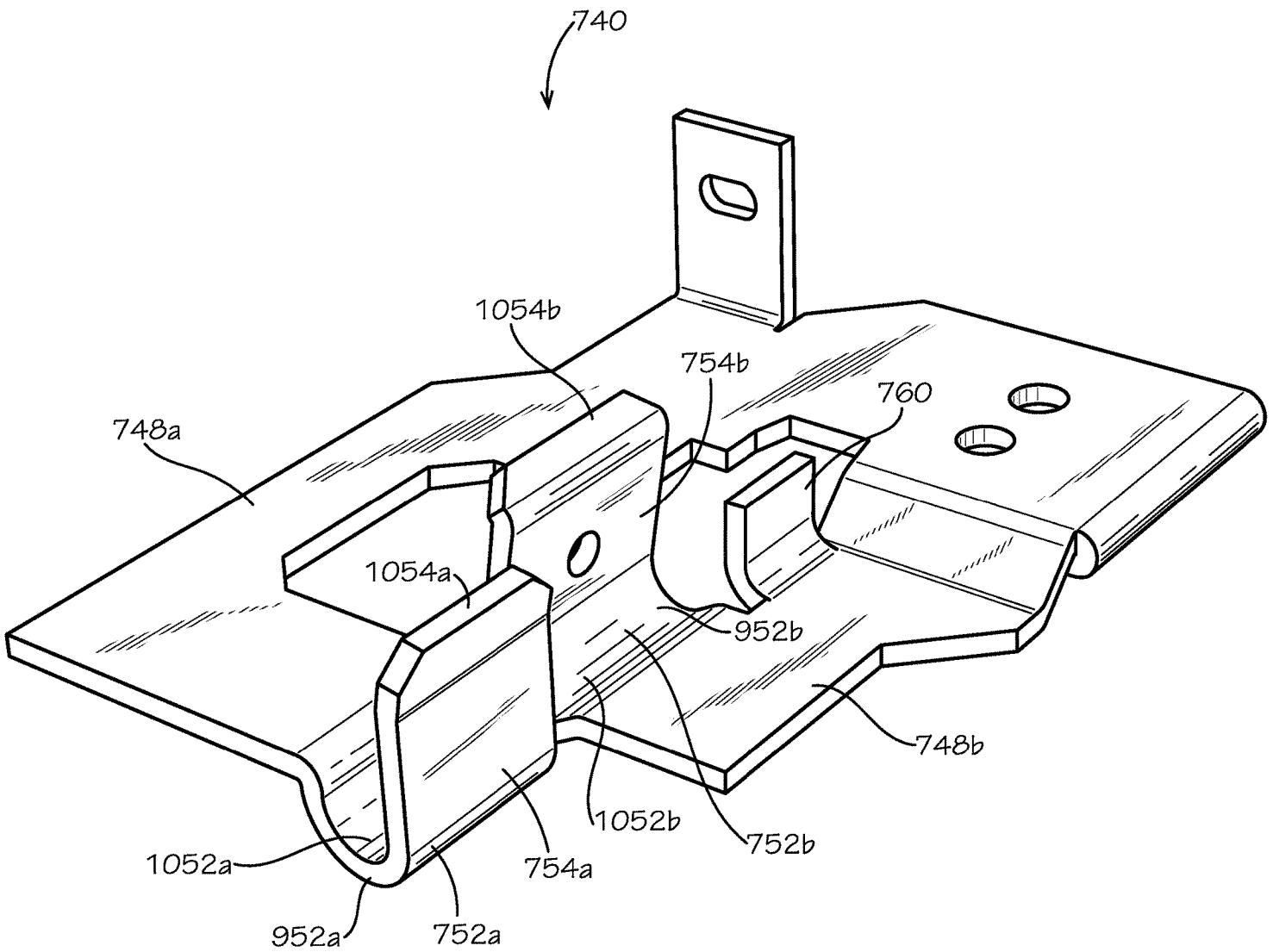
FIG. 10 is a perspective bottom view of the mounting bracket of FIG. 9.

FIG. 10 is a perspective bottom view of the mounting bracket 740 of FIG. 7. As shown, the arched portions 952*a,b* of the saddles 752*a,b* can respectively define saddle grooves 1052*a,b*. The saddle grooves 1052*a,b* can be shaped to conform to a cross-section and a curvature of the stiffening channel 219 (shown in FIG. 7) of the grid support 201 (shown in FIG. 7). The first saddle 752*a* can also define an angled tip 1054*a* of the seating member 754*a* that can angle away from the first support arm 748*a* and towards the second support arm 748*b*. Similarly, the second saddle 752*b* can define an angled tip 1054*b* of the seating member 754*b* that can angle away from the second support arm 748*b* and towards the first support arm 748*a*. The angled tips 1054*a,b* can act as guides when placing the mounting bracket 740 over the grid support 201, and the angled tips 1054*a,b* can help align the stiffening channel 219 between the seating members 754*a,b* and the alignment leg 760. In some aspects, the seating members 754*a,b* can elastically deflect when the angled tips 1054*a,b* slip over the stiffening channel 219, thereby causing the saddles 752*a,b* of the support arms 748*a,b* to snap over the stiffening channel 219. Such a snap fit can secure the mounting bracket 740 to the grid support 201.

Figure 11:
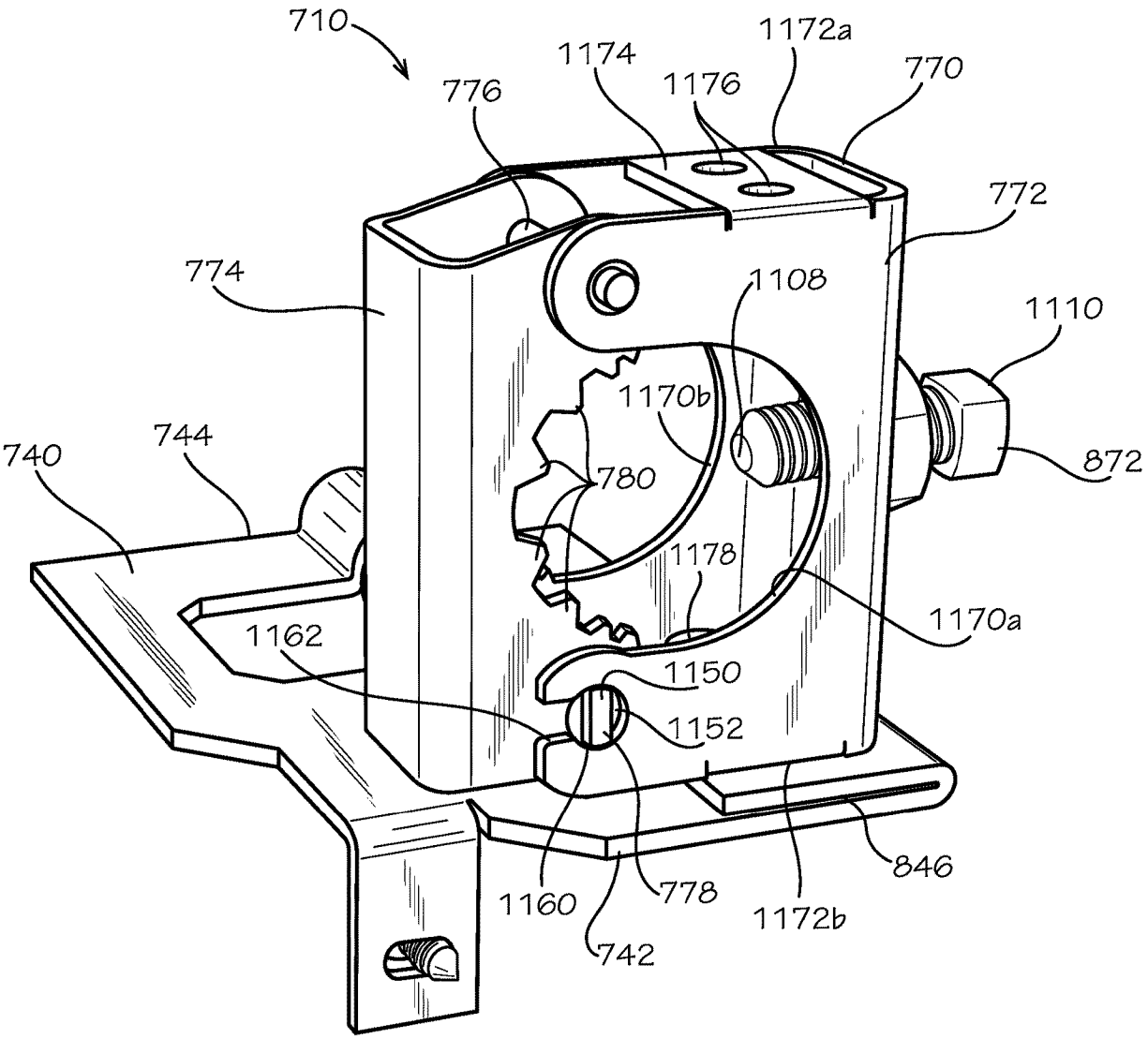
FIG. 11 is a perspective end view of the bracket assembly of FIG. 7 facing a first mount end of the mounting bracket.

FIG. 11 is a perspective end view of the bracket assembly 710 of FIG. 7 facing the first mount end 742 of the mounting bracket 740. The first clamp bracket 772 and the second clamp bracket 774 can together define a first opening 1170*a* and a second opening 1170*b* of the clamp 770. The first opening 1170*a* can be defined towards the first mount end 742 of the mounting bracket 740, and the second opening 1170*b* can be defined towards the second mount end 744 of the mounting bracket 740. The second clamp bracket 774 can define the plurality of teeth 780 around each of the openings 1170*a,b*, as shown in the present aspect and in FIG. 7. The first opening 1170*a* and the second opening 1170*b* can be aligned, and the openings 1170*a,b* can be configured to receive the sprinkler drop 285 (shown in FIG. 7).

The adjustment screw 872 can define a first end 1108 and a second end 1110. The first end 1108 can extend inwards from the first clamp bracket 772 towards the second clamp bracket 774. The second end 1110 can extend outwards from the first clamp bracket 772 and away from the second clamp bracket 774. The second end 1110 can define a head shaped to receive a wrench, socket, spanner, screwdriver, or other tool. By rotating the second end 1110, the first end 1108 of the adjustment screw 872 can translate inwards towards the second clamp bracket 774 or outwards and away from the second clamp bracket 774. When the sprinkler drop 285 is received within the openings 1170*a,b* of the clamp 770, rotating the adjustment screw 872 inwards can engage the first end 1108 with the sprinkler drop 285 and can press the sprinkler drop 285 into the plurality of teeth 780. Pressing the sprinkler drop 285 into the plurality of teeth 780 can positively secure the sprinkler drop 285 to the clamp 770.

The first clamp bracket 772 of the clamp 770 can define a first end 1172*a* and a second end 1172*b* disposed opposite from the first end 1172*a*. Each end 1172*a,b* can define a mounting bracket, as demonstrated by the mounting bracket 1174 at the first end 1172*a*. The mounting bracket 1174 can define a pair of holes 1176 positioned to align with the top holes 960 (shown in FIG. 9) and the bottom holes 962 (shown in FIG. 9) of the mounting pad 846. In the present aspect, the second end 1172*b* can be secured to the mounting pad 842 by a pair of fasteners 1178. In the present view, a portion of one of the fasteners 1178 is shown through the first opening 1170*a*. In the present aspect, the clamp 770 orientation can be reversible, such as by flipping the clamp 770 upside down, to attach the first end 1172*a* to the mounting pad 842 with the mounting bracket 1174 of the first end 1172*a*.

As previously described, the first clamp bracket 772 and the second clamp bracket 774 can be hingedly connected by the hinge pin 776. In the present aspect, the clamp 770 is shown secured in the closed position by the clasp 778. The clasp 778 is shown in a secured position wherein the second clamp bracket 774 is prevented from pivoting about the hinge pin 776 relative to the first clamp bracket 772. The clasp 778 can define a rounded body 1152 and a scalloped end 1150. A shape of the scalloped end 1150 can be defined by two parallel chords extending across the scalloped end 1150. In other aspects, the scalloped end 1150 can be substantially rectangular or any other suitable shape. The rounded body 1152 can extend through the second clamp bracket 774, thereby mounting the clasp 778 to the second clamp bracket 774. The scalloped end 1150 can selectively engage the first clamp bracket 772. The first clamp bracket 772 can define a substantially circular hole 1160 that can be intersected by a slot 1162. The slot 1162 can define a width less than equal to a diameter of the substantially circular hole 1160.

In the aspect shown, the clasp 778 can be rotated to the secured position wherein a length of the scalloped end 1150 is substantially perpendicular to the slot 1162. The length of the scalloped end 1150 can be substantially equal to the diameter of the substantially circular hole 1160. With the scalloped end 1150 positioned perpendicular to the slot 1162, the scalloped end 1150 cannot pass through the slot 1162 to permit the second clamp bracket 774 to pivot away from the first clamp bracket 772 towards an open position (not shown). If the clasp 778 is rotated 90-degrees to an unsecured position, a width of the scalloped end 1150, being less than the length, can pass through the slot 1162 allowing the second clamp bracket 774 to pivot away from the first clamp bracket 772 towards the open position. In the open position, the sprinkler drop 285 can be inserted or removed from the clamp 770.

Figure 12:
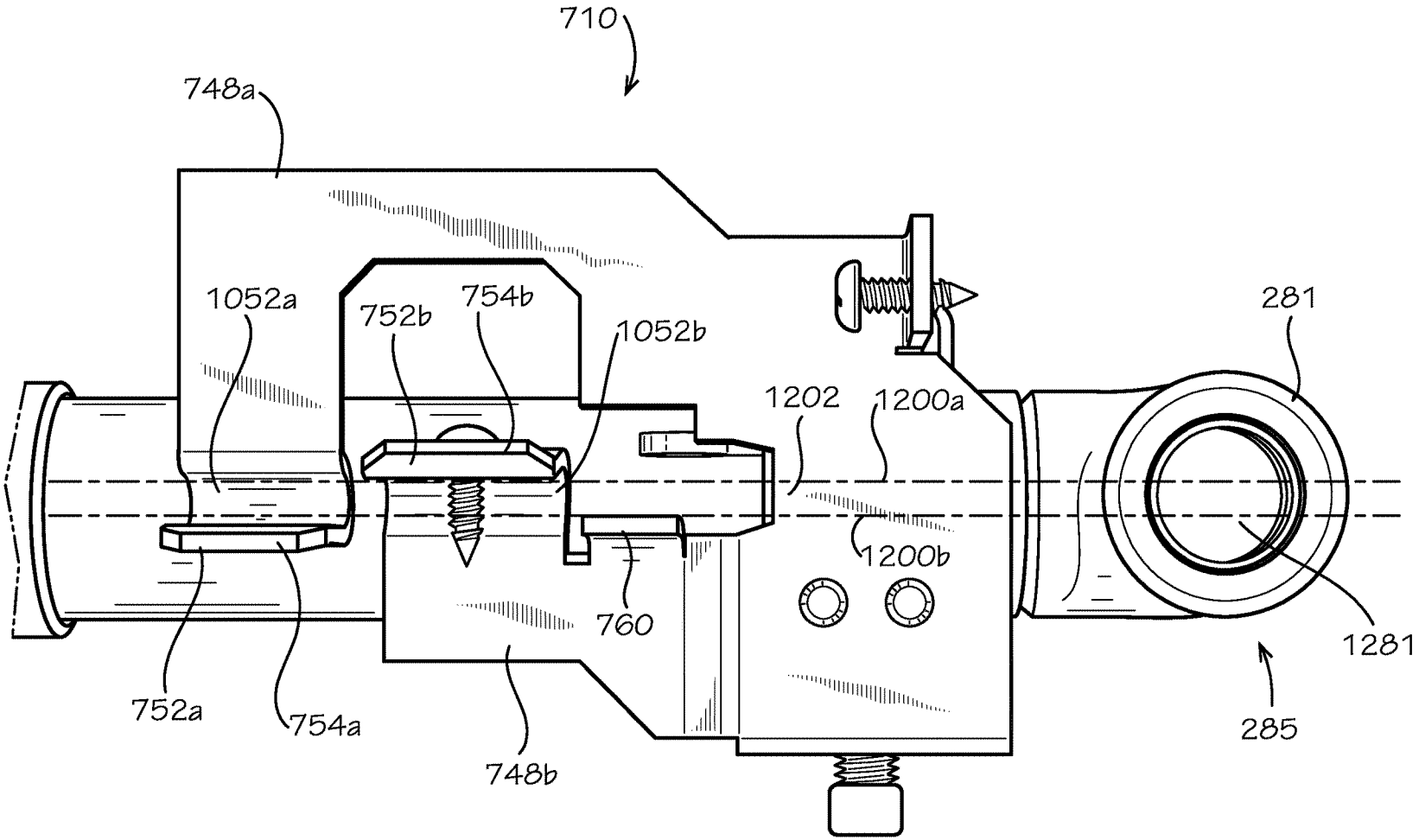
FIG. 12 is a bottom view of the sprinkler drop of FIG. 5 and the bracket assembly of FIG. 7.

FIG. 12 is a bottom view of the sprinkler drop 285 of FIG. 5 and the bracket assembly 710 of FIG. 7. Lines 1200*a* and 1200*b* identify the mounting channel 1202, disposed between lines 1200*a,b*, for attaching the bracket assembly 710 to the grid support 201 (shown in FIG. 7). The mounting channel 1202 can be defined by the saddle grooves 1052*a,b* and the seating members 754*a,b* of the respective saddles 752*a,b* as well as the alignment leg 760. The mounting channel 1202 can extend between the support arms 748*a,b*. The mounting channel 1202 can be aligned with an elbow opening 1281 of the elbow 281 of the sprinkler drop 285 to ensure alignment of the sprinkler drop 285 with the central area/opening 273 (shown in FIG. 5) of the suspension frame 235 (shown in FIG. 5).

While the present disclosure has been described with reference to certain approaches, numerous modifications, alterations and changes to the described approaches are possible without departing from the sphere and scope of the present disclosure, as defined in the appended claims. Accordingly, it is intended that the present disclosure not be limited to the described approaches, but that it has the full scope defined by the language of the following claims, and equivalents thereof. While the disclosure has been described with reference to certain approaches, numerous modifications, alterations and changes to the described approaches are possible without departing from the spirit and scope of the disclosure, as defined in the appended claims. Accordingly, it is intended that the present disclosure not be limited to the described approaches, but that it has the full scope defined by the language of the following claims, and equivalents thereof.

What is claimed is:

1. A bracket assembly comprising:

a mounting bracket comprising a main body and at least one support arm, the at least one support arm extending outward from the main body and comprising a first support arm and a second support arm, the main body defining a mounting pad;

a clamp attached to the mounting pad;

a first saddle attached to the first support arm opposite from the main body; and a second saddle attached to the second support arm opposite from the main body, the second saddle positioned between the first saddle and the main body.

2. The bracket assembly of claim 1, wherein:

the first saddle defines a first saddle groove;

the second saddle defines a second saddle groove; and the first saddle groove aligns with the second saddle groove to define a mounting channel.

3. The bracket assembly of claim 2, wherein:

the first support arm extends along a first side of the mounting channel; and the second support arm extends along a second side of the mounting channel.

4. The bracket assembly of claim 1, wherein the second support arm defines an alignment leg extending downwards.

5. The bracket assembly of claim 1, wherein:

the mounting bracket defines a base layer and a mounting tab; and the mounting tab is folded about a fold line relative to the base layer to define the mounting pad.

6. The bracket assembly of claim 5, wherein:

the mounting tab defines a pair of top holes;

the base layer defines a pair of bottom holes; and the pair of top holes aligns with the pair of bottom holes.

7. The bracket assembly of claim 1, wherein:

the clamp comprises a first clamp bracket and a second clamp bracket;

the first clamp bracket is hingedly connected to the second clamp bracket; and the first clamp bracket is mounted to the mounting pad.

8. A bracket assembly comprising:

a mounting bracket comprising a main body and at least one support arm, the at least one support arm extending outward from the main body, the main body defining a mounting pad; and a clamp attached to the mounting pad, the clamp comprising a first clamp bracket and a second clamp bracket, the first clamp bracket being hingedly connected to the second clamp bracket, and the first clamp bracket being mounted to the mounting pad;

wherein the at least one support arm comprises a first support arm and a second support arm;

wherein the bracket assembly further comprises a first saddle attached to the first support arm opposite from the main body; and wherein the bracket assembly further comprises a second saddle attached to the second support arm opposite from the main body, the second saddle positioned between the first saddle and the main body.

9. The bracket assembly of claim 8, wherein:

the first saddle defines a first saddle groove;

the second saddle defines a second saddle groove; and the first saddle groove aligns with the second saddle groove to define a mounting channel.

10. The bracket assembly of claim 9, wherein:

the first support arm extends along a first side of the mounting channel; and the second support arm extends along a second side of the mounting channel.

11. The bracket assembly of claim 8, wherein the second support arm defines an alignment leg extending downwards.

12. The bracket assembly of claim 8, wherein:

the mounting bracket defines a base layer and a mounting tab; and the mounting tab is folded about a fold line relative to the base layer to define the mounting pad.

13. The bracket assembly of claim 12, wherein:

the mounting tab defines a pair of top holes;

the base layer defines a pair of bottom holes; and the pair of top holes aligns with the pair of bottom holes.

14. The bracket assembly of claim 8, wherein the first clamp bracket is hingedly connected to the second clamp bracket by a hinge pin.

* * * * *